United States Patent [19]

Hintzen et al.

[11] Patent Number: 5,058,784

[45] Date of Patent: Oct. 22, 1991

[54] CLOSING AND/OR REGULATING APPARATUS FOR TAPPING MOLTEN METAL FROM A METALLURGICAL VESSEL

[75] Inventors: Ulrich Hintzen, Taunusstein-Watzhahn; Ernst Lührsen, Bad Schwalbach; Andreas Schuler, Taunusstein, all of Fed. Rep. of Germany

[73] Assignee: Didier-Werke AG, Wiesbaden, Fed. Rep. of Germany

[21] Appl. No.: 597,662

[22] Filed: Oct. 17, 1990

[30] Foreign Application Priority Data

Oct. 17, 1989 [DE] Fed. Rep. of Germany ..... 3934601

[51] Int. Cl.[5] ..... B22D 41/08

[52] U.S. Cl. ..... 222/598; 222/603; 222/591

[58] Field of Search ..... 222/591, 590, 603, 598, 222/599; 266/217, 220

[56] References Cited

U.S. PATENT DOCUMENTS 3,651,998 3/1972 Rocher ..... 222/603

FOREIGN PATENT DOCUMENTS 0308597 3/1989 European Pat. Off. ..... 222/598
3540202C1 11/1985 Fed. Rep. of Germany .
3826245 2/1990 Fed. Rep. of Germany ..... 222/598
WO88/04209 6/1988 PCT Int'l Appl. .

*Primary Examiner*—S. Kastler
*Attorney, Agent, or Firm*—Wenderoth, Lind & Ponack

[57] ABSTRACT

A closing and/or regulating apparatus for tapping molten metal from the interior of the metallurgical vessel includes an inner refractory pipe having extending through a wall thereof at least one opening and an outer refractory pipe fitted over the inner pipe and having extending through a wall thereof at least one opening. Outer and inner surfaces of the inner and outer pipes, respectively, define mating sealing surfaces. One of the pipes is fixedly mounted to a metallurgical vessel, and the other pipe is movable axially and/or rotatably relative to the one pipe to thereby selectively bring the openings to the two pipes relatively into and out of alignment. The inner pipe has adjacent an inner end thereof at a position inwardly of the opening therein a closure closing the interior of the inner pipe. The outer pipe defines therein a space forming a gas distribution chamber at a location confronting the closure. A gas, for example an inert gas, is introduced into the gas distribution chamber such that the gas passes therefrom between the sealing surfaces and into the openings.

8 Claims, 2 Drawing Sheets

CLOSING AND/OR REGULATING APPARATUS FOR TAPPING MOLTEN METAL FROM A METALLURGICAL VESSEL

BACKGROUND OF THE INVENTION

The present invention relates to an apparatus for use in closing and/or regulating, i.e. controlling the discharge, of molten metal from the interior of the metallurgical vessel. The apparatus of the present invention is of the type including an inner refractory pipe having extending through the wall thereof to the interior thereof one or more openings, and an outer pipe fitted over the inner pipe and having extending through a wall thereof one or more openings. The outer and inner surfaces of the inner and outer pipes, respectively, are cylindrical and define mating sealing surfaces. One of the pipes is adapted to be fixedly mounted with respect to a metallurgical vessel, for example the bottom thereof, and the other of the pipes is movable, for example axially and/or rotatably, relative to the one pipe to thereby selectively bring the openings of the two pipes relatively into and out of alignment. Thus, by such movement it is possible to regulate and/or stop the discharge, i.e. tapping, of molten metal from the interior of the metallurgical vessel.

An apparatus of this type is disclosed in German DE 35 40 202 Cl. This known apparatus does not have provision for achieving rinsing of the active surfaces of the apparatus with an inert gas. WO 88/04 209 Al discloses a stopper wherein sealing surfaces between a stationary part and a movable part can be rinsed with an inert gas. The openings through the movable part however cannot be rinsed by the inert gas.

SUMMARY OF THE INVENTION

With the above discussion in mind, it is an object of the present invention to provide an improved closing and/or regulating apparatus of the above described type, but wherein it is possible to rinse or wash the sealing surfaces between the two pipes and the openings through the two pipes with inert gas.

This object is achieved in accordance with the present invention by the provision that an inner end of the inner pipe, i.e. that end positioned within the outer pipe, is provided with a closure member that closes the interior of the inner pipe. Such closure member is positioned inwardly of the opening or openings through the wall of the inner pipe. Furthermore, the outer pipe defines therein a space forming a gas distribution chamber at a location confronting the closure. There is provided means for introducing gas, preferably an inert gas, into the gas distribution chamber such that the gas passes from such gas distribution chamber between the sealing surfaces between the two pipes and into and through the openings in the pipes.

Due to the fact that the inert gas passes between the sealing surfaces, there is achieved an inert gas buffer or lubricant that counteracts friction between and wear of the two sealing surfaces. By the provision of the gas distribution chamber internally of the apparatus it is guaranteed that the gas is uniformly distributed between the two sealing surfaces over the entire circumference of the inner pipe. Furthermore, the inert gas flows through the openings into the molten metal. As a result, wear of the edges or rims of the openings due to abrasion and erosion by the molten metal is reduced. Yet further, the inert gas prevents any tendency of the molten metal from sticking or adhering at and in the openings. Even further, the inert gas entering the molten metal facilitates the separation of contaminants from the molten metal and thereby the homogenization of the molten metal. It is a particularly advantageous feature of the present invention that the inert gas flows toward the molten metal in a direction opposite to the flow of the molten metal through the openings in the pipes.

In accordance with one embodiment of the present invention, the closure is permeable to the inert gas. Accordingly, a portion of the inert gas flows through the closure into the interior of the inner pipe. The remaining portion of the inert gas passes between the two sealing surfaces. By providing the closure to be gas-permeable, it is possible to ensure that the inert gas flows both through the openings through the inner pipe as well as the openings through the outer pipe.

In accordance with a further embodiment of the present invention, the wall of the outer pipe has extending therethrough one or more gas channels from the gas distribution chamber to the opening or openings through the outer pipe. As a result, the openings through the outer pipe are rinsed not only by the current of inert gas that has passed between the sealing surfaces, but also by an additional current of inert gas. Similarly, the wall of the inner pipe can have therein one or more gas channels extending from the gas distribution chamber to the opening or openings through the inner pipe. Additionally or alternatively, the inner pipe can have one or more gas channels extending from an outer end of the inner pipe to the opening or openings therethrough. In this manner, the inert gas current flowing through the opening or openings through the inner pipe can be increased.

BRIEF DESCRIPTION OF THE DRAWINGS

Other objects, features and advantages of the present invention will be apparent from the following detailed description of preferred embodiments thereof, taken with the accompanying drawings, wherein.

DETAILED DESCRIPTION OF THE INVENTION

Figure 1:
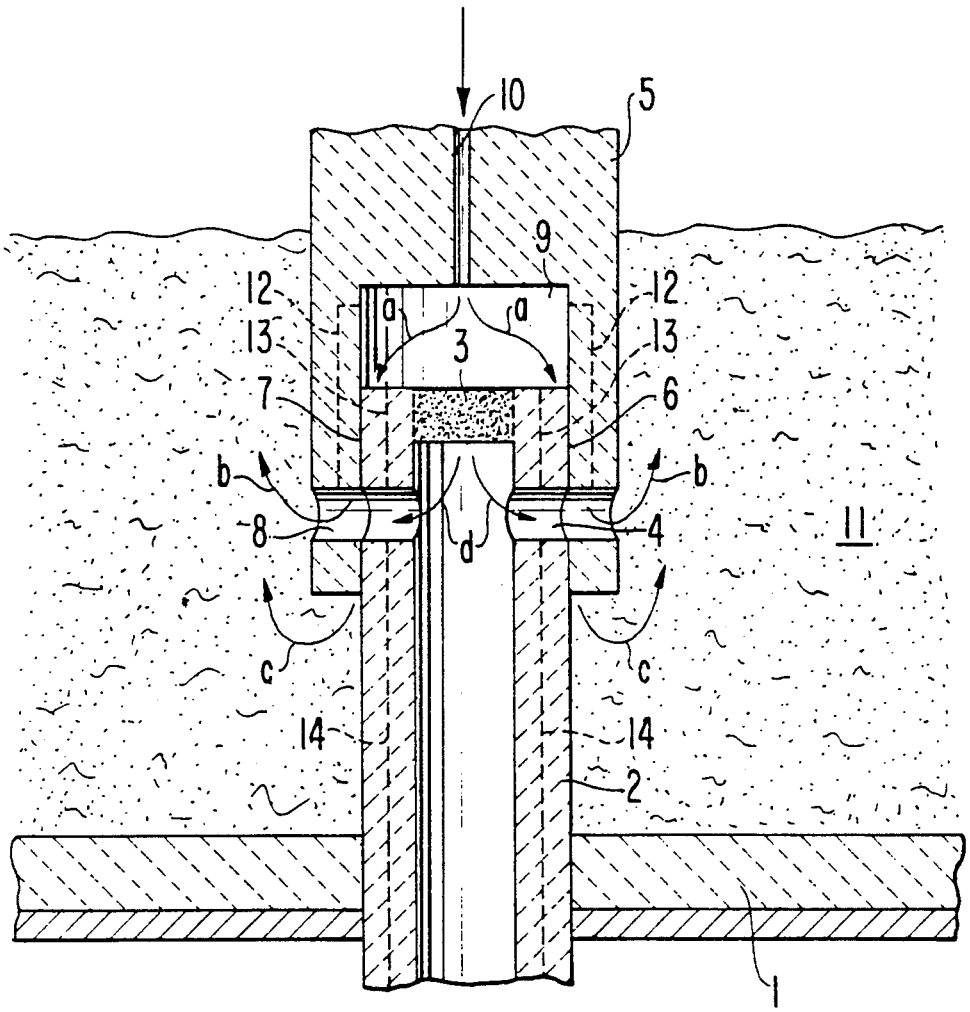
FIG. 1 is a somewhat schematic sectional view of an apparatus in accordance with a first embodiment of the present invention, the apparatus being shown in operative position in the bottom of a metallurgical vessel.

In FIG. 1 there is shown schematically a bottom 1 of a metallurgical vessel containing in the interior thereof molten metal 11. Extending through the bottom 1 is an inner pipe 2 formed of a refractory ceramic material that would be understood by one skilled in the art. Inner pipe 2 is fixedly mounted to bottom 1. Extending through the wall of inner pipe 2 into the hollow interior thereof is at least one flow through opening 4, two such openings being illustrated. Above, i.e. inwardly, of openings 4, the inner end of the hollow interior of inner pipe 2 is closed and sealed by means of a closure 3. In the illustrated embodiment, closure 3 is formed by a gas-permeable insert. Closure 3 however also could be formed integrally with inner pipe 2.

Fitted over the top or inner end of inner pipe 2 is a movable member 5 formed of a refractory ceramic material as would be understood by one skilled in the art. Member 5 extends above the upper level of the molten material 11. The structure of member 5 is such as to achieve at the lower end thereof an outer pipe, although for simplicity the member 5 hereinafter will be referred to as an outer pipe. Extending through the wall of the outer pipe 5 are one or more flow through openings 8, two being illustrated. In a manner that would be understood by one skilled in the art, outer pipe 5 is movable relative to inner pipe 2, for example axially and/or rotatably, to bring openings 8 relatively into and out of alignment with openings 4. In this manner it is possible to close the discharge of molten metal from the interior of the metallurgical vessel, to fully open openings 8, 4, and/or to regulate the relative degree of discharge.

Outer pipe 5 has an inner cylindrical surface 6 and inner pipe 2 has an outer cylindrical surface 7. These two surfaces mate, in various manners as would be understood by one skilled in the art, to define sealing surfaces.

Within the interior of outer pipe 5, at a position above the inner end of inner pipe 2, there is formed a space defining a gas distribution chamber 9. A gas channel 10 extends generally axially through outer pipe 5 into gas distribution chamber 9. As a result, it is possible to introduce an inert gas, for example argon, through channel 10 into gas distribution chamber 9. The inert gas flows in the directions of arrows a and passes between sealing surfaces 6, 7. The gas then passes in part in the directions indicated by arrows b through openings 8 into molten metal 11 and in part in the directions indicated by arrows c and exits at the bottom edge of outer pipe 5 into the molten metal 11. Another portion of the inert gas leaves gas distribution chamber 9 and passes through gas permeable closure 3 into the interior of inner pipe 2 and therefrom flows in the directions indicated by arrows d through openings 4, 8 into the molten metal 11.

When the apparatus is in the open position indicated in FIG. 1, molten metal 11 passes through openings 8, 4 into the interior of inner pipe 2 and then discharges therethrough in a downward direction. The inert gas flows in the directions indicated by arrows d and b through the openings 4, 8 in directions opposite to the discharge flow of the molten metal 11.

To improve or increase the quantity of gas flow through openings 4, 8, it is possible to provide gas channels 12, 13, 14 to extend through the walls of outer pipe 5 and/or inner pipe 2. These gas channels are indicated in dashed lines in FIG. 1. Gas channels 12 extend through the wall of outer pipe 5 from gas distribution chamber 9 to openings 8. Gas channels 13 extend through the wall of inner pipe 2 from gas distribution chamber 9 to openings 4. Gas channels 14 extend through the wall of inner pipe 2 from a position at the lower end thereof outwardly of, i.e. below, bottom 1 to openings 4.

Figure 2:
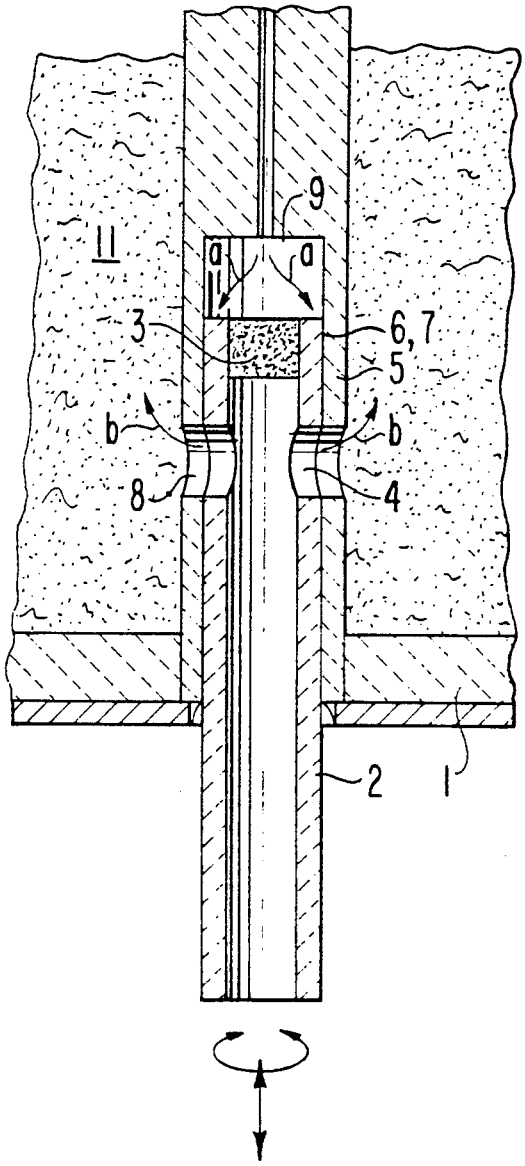
FIG. 2 is a view similar to FIG. 1 but of a second embodiment of an apparatus according to the present invention.

The embodiment of FIG. 2 differs from the embodiment of FIG. 1 in that the inner pipe 2 is the movable pipe, whereas outer pipe 5 is fixed to the bottom 1 of the metallurgical vessel. Inner pipe 2 is inserted from below into outer pipe 3 and can be moved, in manners that would be understood by one skilled in the art, relative to outer pipe 5, for example axially and/or rotatably, to bring openings 4 relatively into and out of alignment with openings 8. In all other respects, the embodiment of FIG. 2 operates in the same manner as described above regarding the embodiment of FIG. 1. Thus, gas distribution chamber 9 is provided within outer pipe 5 above the inner end of inner pipe 2 in confronting closure 3. Sealing surfaces 6, 7 and openings 4, 8 are rinsed by a gas, preferably an inert gas, in precisely the same manner as described above with regard to the embodiment of FIG. 1. It particularly is contemplated that the embodiment of FIG. 2 can include the gas channels 12, 13, 14.

Although the present invention has been described and illustrated with respect to preferred features thereof, it is to be understood that various changes and modifications may be made to the specifically described and illustrated features without departing from the scope of the present invention. Particularly, gas could be introduced into distribution chamber 9 by a channel 10 located at a position other than as illustrated.

We claim:

1. In a closing and regulating apparatus for tapping molten metal from the interior of a metallurgical vessel, said apparatus including an inner pipe having extending through a wall thereof at least one opening and an outer pipe fitted over said inner pipe and having extending through a wall thereof at least one opening, outer and inner surfaces of said inner and outer pipes, respectively, defining mating sealing surfaces, one of said pipes to be fixedly mounted with respect to a metallurgical vessel, and the other of said pipes being movable relative to said one pipe to thereby selectively bring said openings of the two pipes relatively into and out of alignment, the improvement comprising:

said inner pipe having adjacent an inner end thereof at a position inwardly of said opening therein a closure closing the interior of said inner pipe;

said outer pipe defining therein a space forming a gas distribution chamber at a location confronting said closure; and means for introducing gas into said gas distribution chamber such that said gas passes therefrom between said sealing surfaces into said openings.

2. The improvement claimed in claim 1, wherein said gas introducing means comprises a gas channel extending through said outer pipe.

3. The improvement claimed in claim 1, wherein said closure is gas permeable, whereby some of the gas in said gas distribution chamber passes into said interior of said inner pipe.

4. The improvement claimed in claim 1, further comprising at least one gas channel extending through said outer pipe from said gas distribution chamber to said opening through said outer pipe.

5. The improvement claimed in claim 1, further comprising at least one gas channel extending through said inner pipe from said gas distribution chamber to said opening through said inner pipe.

6. The improvement claimed in claim 1, further comprising at least one gas channel extending through said inner pipe from an outer end thereof to said opening through said inner pipe.

7. The improvement claimed in claim 1, wherein said one pipe is said inner pipe, and said other pipe is said outer pipe.

8. The improvement claimed in claim 1, wherein said one pipe is said outer pipe, and said other pipe is said inner pipe.

* * * * *